US006237782B1

(12) United States Patent
Hunn

(10) Patent No.: US 6,237,782 B1
(45) Date of Patent: May 29, 2001

(54) DISPLAY SYSTEM

(75) Inventor: Larry Hunn, Dunwoody, GA (US)

(73) Assignee: Schutz International Inc., Morton Grove, IL (US)

( * ) Notice: Subject to any disclaimer, the term of this patent is extended or adjusted under 35 U.S.C. 154(b) by 0 days.

(21) Appl. No.: 09/127,250

(22) Filed: Jul. 31, 1998

(51) Int. Cl.[7] ..... A47F 7/16

(52) U.S. Cl. ..... 211/47; 211/45; 40/723; 40/729

(58) Field of Search ..... 211/47, 44, 45, 211/46; 40/124, 723, 731, 730, 729, 376, 377, 382, 391; D6/582, 409, 437, 454; 206/449

(56) References Cited

U.S. PATENT DOCUMENTS

D. 368,181 * 3/1996 Dabrowski ..... D6/409
447,815 * 3/1891 Frercks ..... 40/729 X
1,026,561 * 5/1912 Charlet ..... 211/47 X
1,588,299 * 6/1926 Boucher ..... 40/377
3,145,845 * 8/1964 Best ..... 211/44
3,777,896 * 12/1973 Ehrlich ..... 211/47 X
5,280,840 * 1/1994 Terpening ..... 211/165
5,671,849 * 9/1997 Bacon ..... 211/13
5,715,949 * 2/1998 Rutledge ..... 211/47
5,803,272 * 9/1998 Jimenez et al. ..... 211/47 X
5,806,688 * 9/1998 Adenau et al. ..... 211/47

* cited by examiner

*Primary Examiner*—Daniel P. Stodola
*Assistant Examiner*—Erica B. Harris
(74) *Attorney, Agent, or Firm*—Wood, Phillips, VanSanten, Clark & Mortimer

(57) ABSTRACT

A display system having a first card having oppositely facing first and second surfaces, at least one display object on the first surface, and a spacer assembly with a first spacer element that is attached to the first card and projects from the first surface.

3 Claims, 4 Drawing Sheets

DISPLAY SYSTEM

BACKGROUND OF THE INVENTION

1. Field of the Invention

This invention relates to a system for displaying consumer objects, such as carpet samples.

2. Background Art

Designers of product displays strive to develop systems that allow convenient access to the displayed objects and show the displayed objects in the best possible light. It is common in the carpet industry to display samples on pallet cards. In a typical arrangement, a large swatch of carpet is glued to one surface on the pallet card to allow the potential consumer to identify the carpet style and texture. Smaller swatches of the same carpet style may be glued to the same surface of the pallet card to identify different available colors.

Displays in carpet stores may support a number of the pallet cards. In one form, the pallet cards are pivotably connected at one edge so that the individual pallet cards can be repositioned and inspected in the same manner as pages in a book are turned and observed.

This type of display permits a large number of carpet samples to be set up for convenient viewing in a relatively compact space. The pallet cards can be manipulated with relative ease to allow selective viewing of the various samples available.

One problem with this type of display is that carpet samples have a tendency to become deformed. The swatches project outwardly from the pallet cards and may abut to the back surface of an adjacent pallet card on the display. If a number of the pallet cards are pushed to one side of the display, a substantial compressive force may be exerted on the carpet swatches. The compressed carpet swatches, once exposed by repositioning of the pallet cards, may have a crushed pile which detracts from the appearance of the carpet. This may deter potential consumers from purchasing a particular carpet style.

SUMMARY OF THE INVENTION

The invention is directed to a display system having a first card having oppositely facing first and second surfaces, at least one display object on the first surface, and a spacer assembly with a first spacer element that is attached to the first card and projects from the first surface.

The spacer assembly may have a second spacer element that is attached to the first card at a location spaced from the first spacer element that projects from the first surface.

The spacer assembly may include a second spacer element that is attached to the first card and projects from the second surface.

The first and second spacer elements may be joined, each to the other, through the first card.

A fastener may interconnect the first and second spacer elements. The fastener may be a screw, a bolt, or the like.

One of the first and second spacer elements may have a projection, with there being a receptacle for the projection on the other of the first and second spacer elements.

The projection may be received and frictionally held within the receptacle.

The display object may be a carpet swatch.

The display system may further include a frame and a second card that is substantially the same as the first card, with the first and second cards mounted to the frame for movement relative to each other between a) a first relative position wherein the first card is substantially filly spaced from the second card and b) a second relative position wherein the second card overlies the first card and is abutted to the first spacer element.

The second card may be pivotable relative to the frame and the first card as the cards are moved relative to each other between the first and second relative positions.

The first card may be made from cardboard.

The first spacer element may be made from molded plastic.

The first and second spacer elements may have the same configuration.

In one form, the first spacer element projects from the first surface at least as far as the at least one display object.

The invention is also directed to a display system for an object, which display system has a first card having oppositely facing first and second surfaces and a spacer assembly having a first spacer element that is attached to the first card and projects from the first surface to shield an object to be displayed that is on the first surface.

DETAILED DESCRIPTION OF THE DRAWINGS

Figure 1:
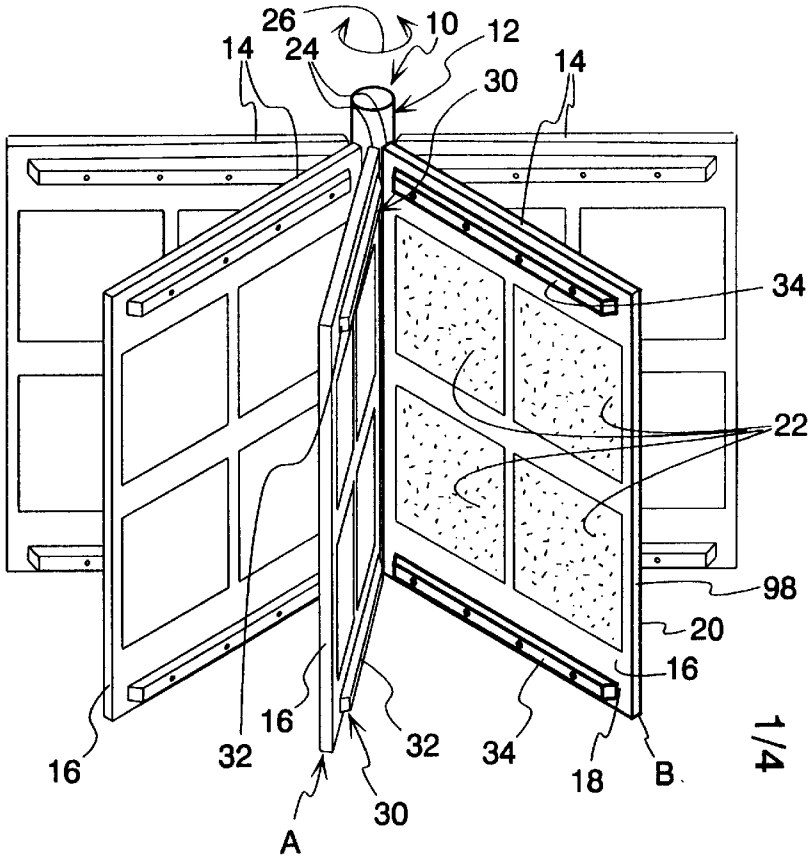
FIG. 1 is a perspective view of a display system having a plurality of relatively movable cards carrying display objects and made according to the present invention.

Referring initially to FIGS. 1–5, one form of display system, according to the present invention, is shown at 10. The display system 10 consists of a frame 12 to which individual pallet cards 14 are mounted for movement relative to each other and to the frame 12. The pallet cards 14 have the same general construction, each with a rectangular, flat body 16 with oppositely facing flat surfaces 18, 20. The display objects, in this case carpet swatches 22, are mounted on one or both of the surfaces 18, 20 in conventional manner.

In the display system 10, the frame 12 serves as a backbone to hingedly connect a rear edge 24 on each pallet card 14 so that the pallet cards 14 can be pivoted at the edges 24 selectively in the direction of the double-headed arrow 26 relative to each other and the frame 12 in the same general manner as pages of a book are turned. By pivoting the cards 14, selected surfaces 18, 20 can be exposed for viewing of the display objects 22 thereon.

Normally, the display objects 22 are mounted to project from one or both of the surfaces 18, 20. When adjacent cards 14 are pivoted into abutment with each other, the display objects, in this case, carpet swatches 22, may become compressed and distorted, thereby detracting from the appearance thereof. To obviate this problem, according to the invention, a spacer assembly 30 is provided on the cards 14. Exemplary card 14, identified at A in FIGS. 1–5, will be used to describe the spacer assembly 30.

The spacer assembly 30 consists of first and second spacer elements 32, 34 projecting outwardly from surfaces 20, 18, respectively, on the card 14. The spacer elements 32, 34 are identical in construction, with the exemplary spacer element 32 described hereinbelow.

The spacer element 32 has a body 38 which, when operatively connected to the card 14, has a flat surface 40 which projects and faces away from the card surface 20, preferably at least as far as the display objects 22 project away from the same surface 20. The spacer assembly 30 has four fastener locations 42, 44, 46, 48 spaced equidistantly along the length of the spacer elements 32, 34. The body 38 has a counterbore 50 and a concentric boss 52 projecting away from the surface 40 at the first fastener location 42. A bore 54 extends fully through the body 38 and is threaded at least through part of the boss 52 to receive a threaded fastener 56, that is a screw or bolt.

The fastener 56 extends through a bore 58 through a body 60 on the spacer element 34. The body 60 has a flat surface 62 that is substantially parallel to the surface 40 and a boss 64 projecting away from the surface 62 and coaxially aligned with the boss 52. A counterbore 66 on the body 60 is deeper than the counterbore 50 on the body 38 to accommodate a head 68 on the fastener 56 so that with the fastener 56 in place, the head 68 is recessed approximately to the depth of the counterbore 50, to give a symmetrical appearance as viewed from opposite sides of the card 14.

The bodies 38, 60 have the same configuration at the fastener location 46 as at the fastener location 42. The body 60 on the spacer element 34 has a boss 70 and a stepped through bore 72 corresponding to the bore 58 and counterbore 66, previously described.

The spacer elements 32, 34 are configured the same at the fastener locations 44, 48 as at the fastener locations 42, 46, with the exception that the locations are reversed, i.e. the fasteners 56 are directed through the spacer element 32 into the spacer element 34, as opposed to being directed through the spacer element 34 into the spacer element 32. With this arrangement, the spacer elements 32, 34 can be made identical in shape and simply inverted endwise to be connected, each to the other.

The card 14 has openings 74 therethrough to accommodate the bosses 52, 64, 70 previously described, and bosses 76, 78, 80 on the body 38 at the fastener locations 44, 46, 48, and bosses 82, 84, 86 on the body 60 at the fastener locations 44, 46, 48.

The openings 74 in the card 14 can be selected to relatively closely accommodate the bosses 52, 64, 70, 76–86 to facilitate location of the spacer elements 32, 34 in the desired operative position on the card 14. The fasteners 56 can then each be directed through one of the spacer elements 32, 34 and threadably engaged with the other of the spacer elements 32, 34. As the fasteners 56 are tightened, surfaces 88, 90 on the spacer elements 32, 34 abut to the card surfaces 20, 18, respectively. Further tightening of the fasteners 56 causes the spacer elements 32, 34 to be positively held in the operative position on the card 14.

Figure 2:
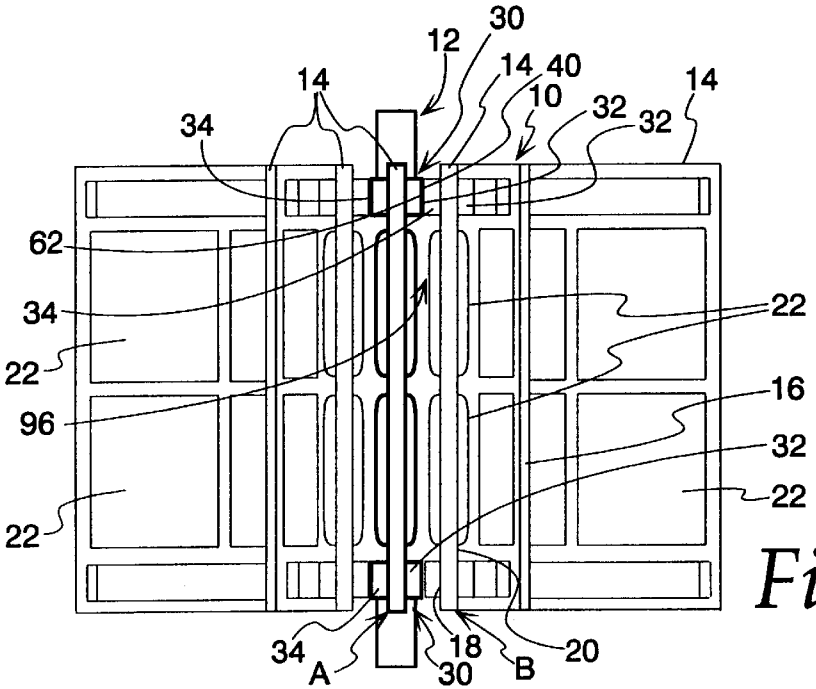
FIG. 2 is a front elevation view of the display system of FIG. 1.
Figure 3:
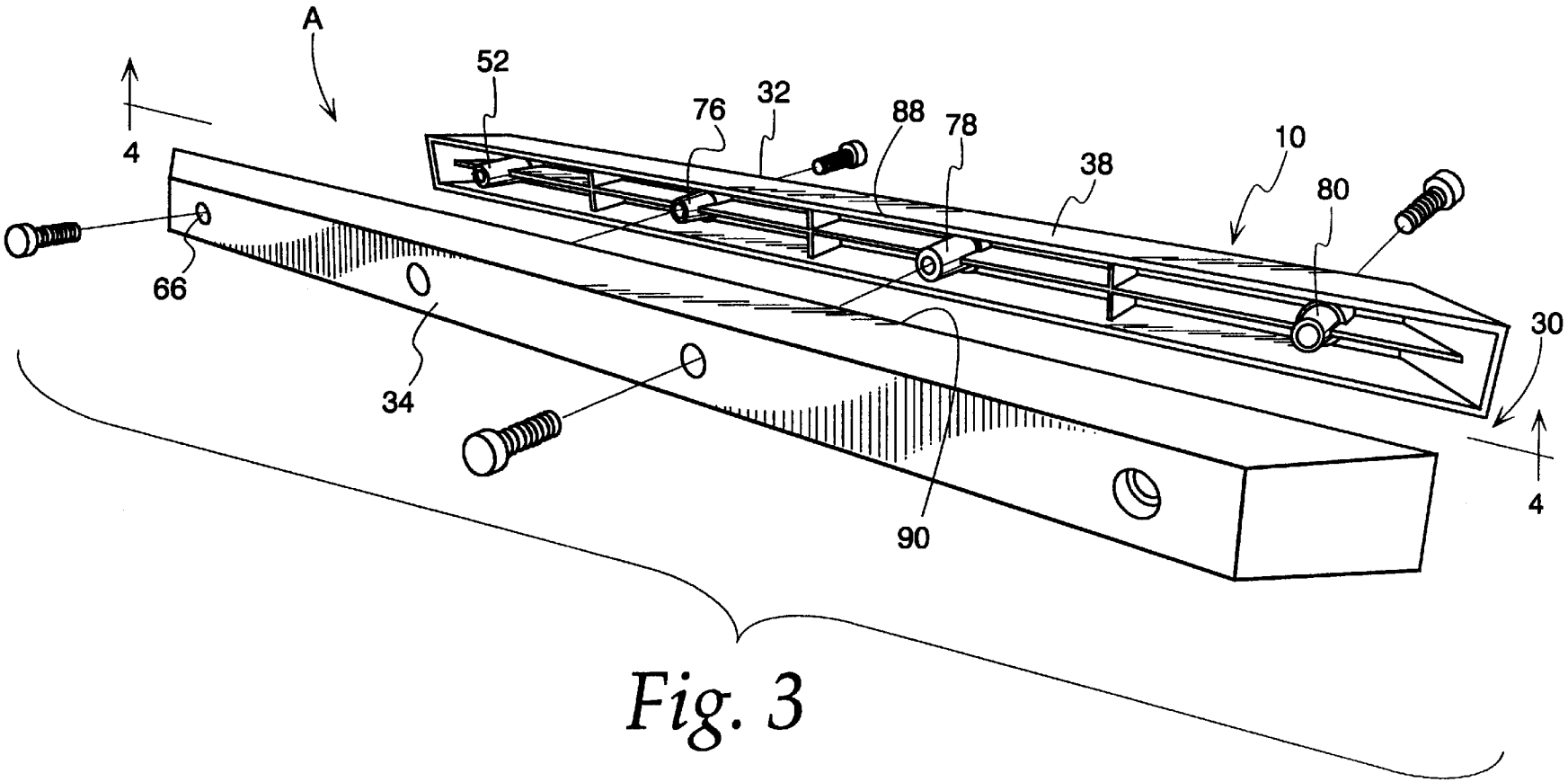
FIG. 3 is an enlarged, exploded, perspective view of a spacer assembly on the cards on the display system of FIGS. 1 and 2.

The spacer elements 32, 34 are similarly operatively connected to each of the cards 14. With this arrangement, as exemplary cards A, B are moved from a first relative position, as shown in FIG. 1, to a second relative position, as shown in FIG. 2, the surface 40 on the spacer element 32 on the card A abuts to the surface 60 on the spacer element 34 on the card B. This arrangement maintains a slight gap 96 between display objects 22 on the cards A, B. Accordingly, the display objects 22 on each of the cards A, B are shielded from the display objects 22 on the other card A, B.

A similar arrangement of spacer elements 32, 34 can be provided on the bottom of each card 14. Spacer elements 32, 34 could be provided elsewhere, such as in a vertical arrangement at the front edge 98 of each card 14.

The exact number of fasteners 56 employed is a matter of design choice. The ends 100, 102 of the spacer element 32 are beveled to enhance appearance and to make the cards 14 more convenient to manipulate by a user thereof.

Figures 4, 5, 6, 7, 8:
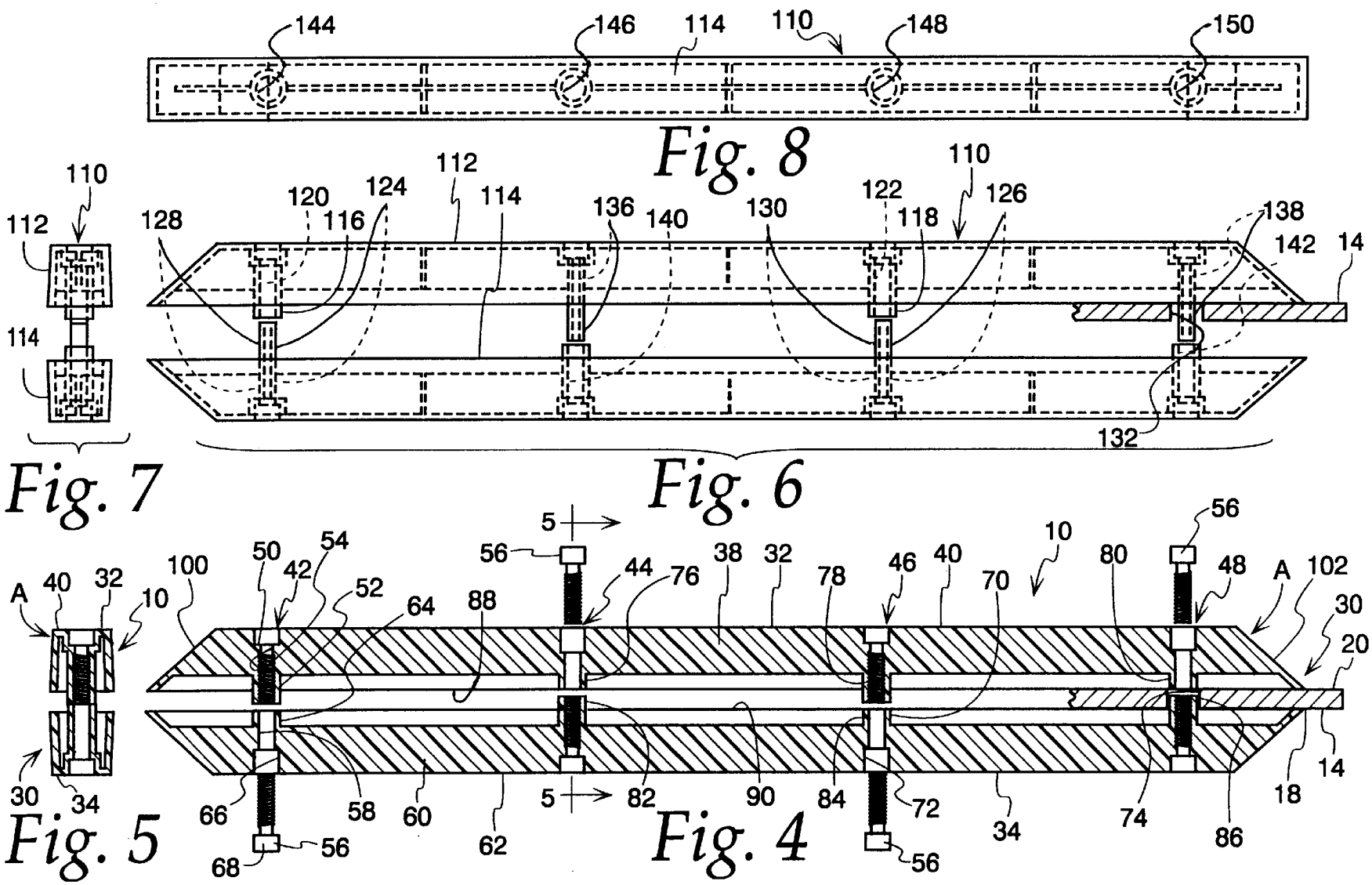
FIG. 4 is an enlarged, cross-sectional view of the spacer assembly taken along line 4—4 of FIG. 3.
FIG. 5 is an enlarged, cross-sectional view of the spacer assembly in an assembled state and taken along line 5—5 of FIG. 4.
FIG. 6 is a plan view of a modified form of spacer assembly, according to the present invention.
FIG. 7 is an end elevation view of the spacer assembly of FIG. 6.
FIG. 8 is a front elevation view of the spacer assembly in FIGS. 6 and 7.

In FIGS. 6–8, a modified form of spacer assembly, according to the present invention, is shown at 110. The spacer assembly 110 has spacer elements 112, 114 corresponding to the spacer elements 32, 34, which have a similar overall shape. The primary distinction between the spacer elements 112, 114 and the spacer elements 32, 34 is in the manner of interconnection of the spacer elements 112, 114 through the cards 14.

Again, the spacer elements 112, 114 can be made with an identical construction so that they are reversible, end-to-end, to be interconnected. In this case, the spacer element 112 has bosses 116, 118 defining receptacles 120, 122 for projections 124, 126 from the spacer element 114. The outer surfaces 128, 130 of the projections 124, 126 are configured to be closely received within the receptacles 120, 122.

By directing the projections 124, 126 into the receptacles 120, 122 through openings 132 (one shown) through the card 14, the projections 124, 126 become frictionally held within the receptacles 120, 122. The projections 124, 126 can be tapered so that the frictional holding force is increased as the spacer elements 112, 114 are moved further towards each other. A similar, but reversed, arrangement of projections 136, 138 on the spacer element 12 and receptacles 140, 142 on the spacer element 114 can be provided.

The spacer elements 112, 114 may have through bores 144, 146, 148, 150 to accommodate optional fasteners, such as screws and bolts, which may be used to secure the connection between the spacer elements 112, 114.

Figure 10:
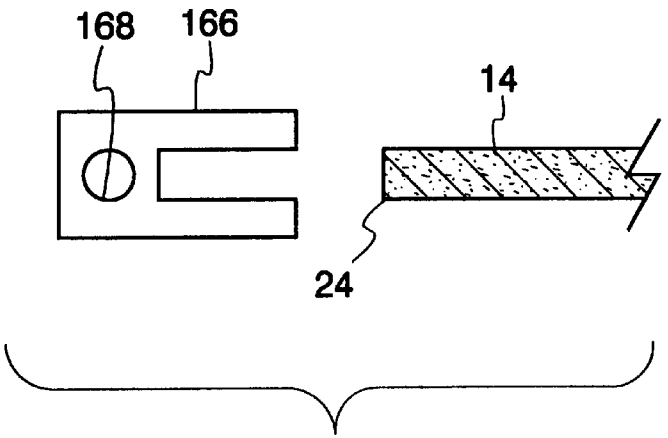
FIG. 10 is an enlarged, fragmentary, plan view of an adaptor for mounting individual cards to a frame on the display system in FIG. 9.
Figure 9:
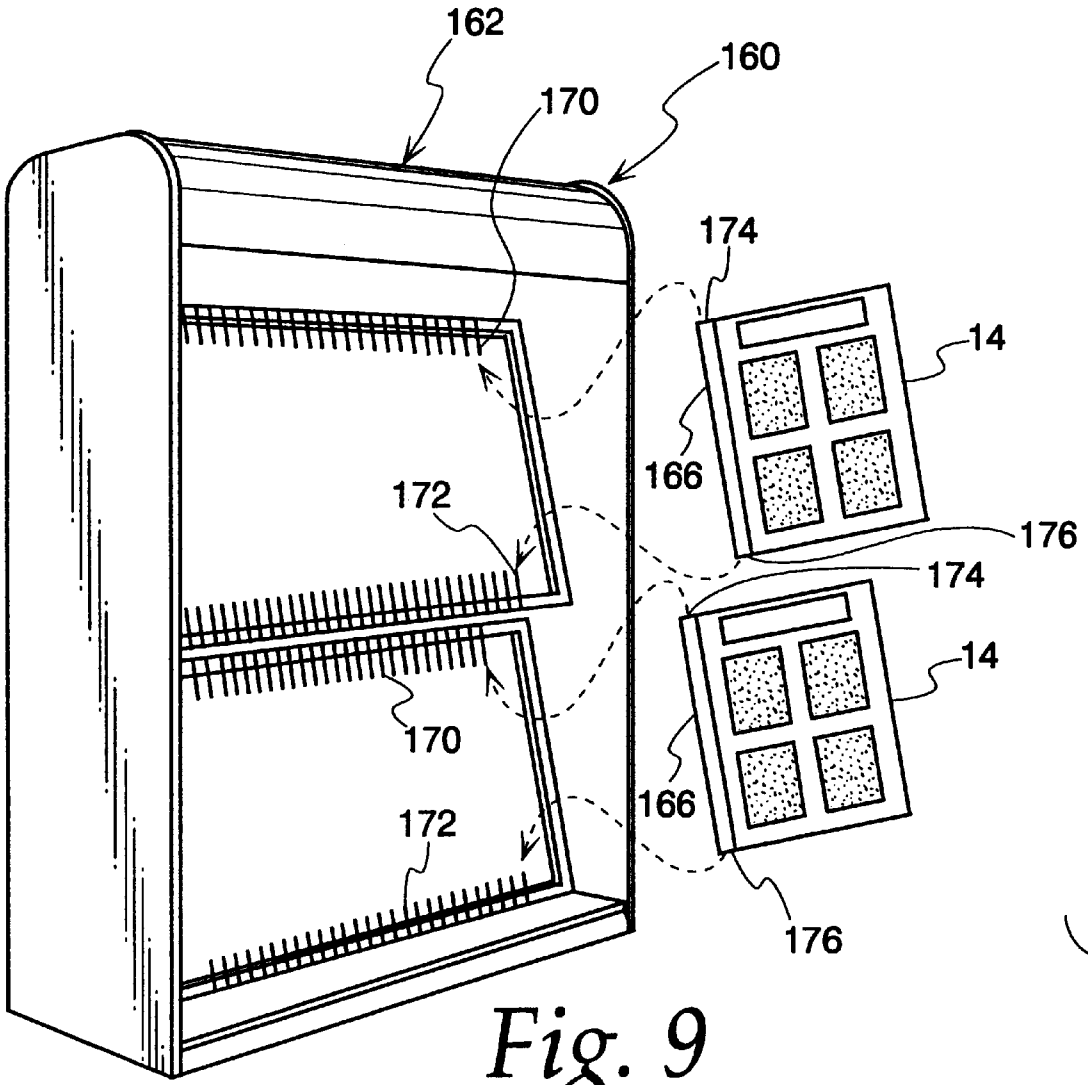
FIG. 9 is a perspective view of a modified form of display system, according to the present invention.

FIGS. 9 and 10 show a display system at 160 having an alternative arrangement for mounting the cards 14 to a frame 162. In this system 160, the rear edge 24 of each card 14 is gripped by a U-shaped extrusion element 166. The extrusion element 166 has a vertical through bore 168 designed to cooperate with a downwardly projecting longer pin 170 and an upwardly projecting, axially aligned, shorter pin 172 on the frame 162. With this arrangement, the pin 170 is aligned with the bore 168 at the upper edge 174 of the extrusion element 166 and the card 14 directed upwardly sufficiently that the lower edge 176 of the extrusion element 166 resides above the pin 172. The card 14 can then be shifted and lowered so that the pin 172 is directed into the bore 168 at the lower edge 176. With this arrangement, the pins 170, 172 cooperatively act as a hinge for the extrusion elements 166. Since the pin 172 is shorter than the pin 170, with the card 14 in its downwardmost position, the pin 170 still resides within the bore 168 to prevent inadvertent separation of the card 14 from the frame 162.

A series of such pins 170, 172 are provided across the width of the frame 162 to accommodate multiple cards 14. A like arrangement of pins 170, 172 is provided on a lower portion of the frame 162 to provide two tiers of repositionable and viewable cards 14.

It should be understood that the inventive concept can be used to display objects other than carpet. Further, the precise configuration of the frame 12, 162 can be modified from that shown. For example, in a simple form, a single ring could function as a frame and be passed through the cards 14, with the display objects thereon shielded from adjacent cards by the spacer assembly 30, described above.

Further, the precise shape of the spacer elements 32, 34, 112, 114 is a matter of design choice, as is also the number and location of fasteners 56. Still further, making the spacer elements 32, 34 and 112, 114 the same, while a convenience, is not necessary. The spacer elements 32, 34, 112, 114, while preferably made from molded plastic, may be made from virtually any shape retentive material.

The foregoing disclosure of specific embodiments is intended to be illustrative of the broad concepts comprehended by the invention.

What is claimed is:

1. A display system comprising:

a first card having oppositely facing first and second, substantially flat, surfaces;

at least one display object on the first surface and projecting in a first direction a first distance from the first surface; and a spacer assembly comprising a first spacer element that is attached to the first card and projects from the first surface, the spacer assembly comprising a second spacer element that is attached to the first card and projects from the first surface, said first and second spacer elements each projecting from the first surface in the first direction a distance at least signal to the first distance, said first and second spacer elements each extending continuously horizontally over the first surface for a substantial distance at first and second vertically spaced locations, wherein the spacer assembly comprises a third spacer element that is attached to the first card and projects from the second surface, wherein the first and third spacer elements are joined, each to the other, through at least one aperture in the first card, wherein there is a projection on one of the first and third spacer elements and a receptacle for the projection on the other of the first and third spacer elements.

2. The display system according to claim 1 wherein the projection is received and frictionally held within the receptacle.

3. A display system comprising:

a first card having oppositely facing first and second, substantially flat, surfaces;

at least one display object on the first surface and projecting in a first direction a first distance from the first surface; and a spacer assembly comprising a first spacer element that is attached to the first card and projects from the first surface, said first spacer element projecting from the first surface in the first direction a distance at least equal to the first distance, wherein the spacer assembly comprises a second spacer element that is attached to the first card and projects from the second surface, wherein the first and second spacer elements are joined, each to the other, through at least one aperture in the first card, wherein there is a projection on one of the first and second spacer elements and a receptacle for the projection on the other of the first and second spacer elements.

* * * * *